United States Patent [19]

Thompson

[11] Patent Number: 4,806,369

[45] Date of Patent: Feb. 21, 1989

[54] METHOD AND APPARATUS FOR MAKING AN INFUSION

[76] Inventor: Owen E. Thompson, 9702 Hedin Dr., Silver Spring, Md. 20903

[21] Appl. No.: 928,322

[22] Filed: Nov. 7, 1986

[51] Int. Cl.[4] ..... A23F 5/26; A23F 3/18; B65D 85/00

[52] U.S. Cl. ..... 426/82; 426/77; 426/80; 426/433; 426/435; 206/0.5; 99/287; 99/295; 99/323

[58] Field of Search ..... 426/77-84, 426/433, 435, 112; 206/0.5; 99/323, 295, 287

[56] References Cited

U.S. PATENT DOCUMENTS

| | | | |
|---|---|---|---|
| 790,626 | 5/1905 | French | 99/323 |
| 1,428,046 | 9/1922 | Mock | 99/287 |
| 1,489,806 | 4/1924 | Anderson | 426/77 |
| 2,123,054 | 7/1938 | Lamb et al. | 426/80 |
| 2,260,858 | 10/1941 | Naef | 426/82 |
| 2,291,060 | 7/1942 | Schiess | 426/82 |
| 2,291,278 | 7/1942 | Cleaves | 426/82 |
| 2,570,997 | 10/1951 | Willman | 99/317 |
| 2,936,695 | 5/1960 | Donot | 99/295 |
| 3,083,101 | 3/1963 | Noury | 426/112 |
| 3,102,465 | 9/1963 | Montesano | 206/0.5 |
| 3,193,388 | 7/1965 | Corney | 426/77 |
| 3,257,212 | 6/1966 | Kasket | 426/82 |
| 3,607,302 | 9/1971 | Beck | 99/295 |
| 3,833,740 | 9/1974 | Schmidt | 426/80 |
| 3,935,318 | 1/1976 | Mihailide | 426/80 |
| 3,946,652 | 3/1976 | Gorin | 99/323 |
| 4,136,202 | 1/1979 | Favre | 99/295 |
| 4,211,156 | 7/1980 | Zimmerman | 426/80 |
| 4,215,628 | 8/1980 | Dodd | 426/82 |
| 4,229,481 | 10/1980 | Fornari | 426/82 |
| 4,278,691 | 7/1981 | Donarumma et al. | 426/80 |
| 4,338,338 | 7/1982 | Popkes | 426/82 |
| 4,410,550 | 10/1983 | Gaskill | 426/82 |
| 4,443,481 | 4/1984 | Donarumma et al. | 426/82 |
| 4,465,697 | 8/1984 | Brice et al. | 426/82 |

FOREIGN PATENT DOCUMENTS

| | | | |
|---|---|---|---|
| 631005 | 6/1936 | Fed. Rep. of Germany | 99/323 |
| 788555 | 4/1935 | France | 426/77 |
| 200975 | 3/1938 | Switzerland | 99/323 |
| 18325 | of 1892 | United Kingdom | 426/433 |
| 14268 | of 1894 | United Kingdom | 99/287 |
| 115197 | 5/1918 | United Kingdom | 99/317 |
| 412097 | 6/1934 | United Kingdom | 426/77 |
| 1503913 | 3/1978 | United Kingdom | 426/0.57 |
| 1575845 | 10/1980 | United Kingdom | 426/77 |
| 1601335 | 10/1981 | United Kingdom | 426/77 |

*Primary Examiner*—Steven Weinstein

[57] ABSTRACT

A device for brewing a beverage comprises a chamber for containing a beverage-making substance, which prevents compaction of substance, wherein the chamber extends a substantial distance above the beverage-making substance. The beverage-making substance, such as ground roasted coffee beans, is retained within the brewer by filters installed in openings at the base and upper ends of the chamber. Seals are secured over the base and upper end openings to preserve the freshness of the beverage-making substance. A user prepares a beverage by removing the seals and moving the device with an up and down motion through water in a cup. The upper end of the brewer is open to the atmosphere, and a pressure head develops between the upper and lower portions of the brewer which greatly increases water flow through the substance. Filaments or protuberances within the device prevent the compaction of wetted beverage-making substance and greatly enhance the free swirling of substance and liquid leading to a quicker and more efficient brewing process.

11 Claims, 3 Drawing Sheets

METHOD AND APPARATUS FOR MAKING AN INFUSION

BACKGROUND OF THE INVENTION

1. Field of the Invention

The present invention relates to solution preparation and, more particularly, to brewing apparatus.

2. Description of the Prior Art

Infusers, which are used to make or brew a single serving of a beverage, for example, coffee, are well known. Generally, an infuser is used to bring a liquid into contact with a solid, usually in particulate form, to produce a potable liquid. The greater the area of the solid that is brought into contact with the liquid, the more quickly the infusion can be made. Also, the infusion can be achieved more quickly if liquid flow is maintained through the solid to repeatedly introduce liquid of lower solid concentration to the solid.

Known infusers work in a variety of ways. Some infusers employ gravitational forces, such as coffee makers in which hot water is poured through ground coffee beans held in a filter device. Some known infusers, such as electric percolators, utilize thermally produced pressure to either force the liquid through a basket holding the ground coffee beans or to draw the liquid through the basket by means of a vacuum created by the thermal forces. Other infusers, such as tea bags and tea balls, utilize turbulence and diffusion forces created by stirring, dunking, or steeping. Infusers are also known that include mechanical apparatus by which hydraulic pressure forces are created within a container. Finally, infusers are known that generate hydrostatic pressure to force liquid through an infusing substance, such as coffee.

Known infusers cannot effectively or practically be used with substances, such as coffee, that are difficult to infuse to produce a single serving. Infusers that include special apparatus for manually forcing the liquid through the solid are not commercially practical as single-serving coffee infusers. Single-serving infusers that are relatively simple in construction, such as bags and other types of liquid permeable containers, cannot develop adequate liquid flow to infuse coffee in a reasonable period of time. Many known infusers also permit the particulate solid to compact, thereby preventing an adequate area of the solid from making contact with the liquid. Such compaction is fatal when infusion of a single serving of coffee is attempted. A good discussion of the compaction problem may be found in U.S. Pat. No. 4,229,481 (hereinafter referred to as the "Fornari patent") at column 1, line 45 through column 2, line 39.

Great Britain Pat. No. 18,325 (hereinafter referred to as the "Bond patent") discloses an infuser device (the "Bond device") of the type that can be used to produce a hydrostatic pressure. The Bond device holds the solid material to be infused and can be raised and lowered in a liquid. The raising of the Bond device partially out of the liquid causes hydrostatic pressure forces to develop. The hydrostatic forces cause a high flow rate. However, the Bond device causes compaction of ground coffee beans contained within the device due to its longitudinally uniform cross section.

The device described in the Fornari patent (the "Fornari device") prevents compaction of ground coffee beans because the sachet which contains the ground coffee changes shape as it is raised and lowered within a container of water. However, the Fornari device cannot develop hydrostatic pressure, and consequently a high flow rate, because the sachet is constructed totally of a permeable material.

U.S. Pat. No. 2,123,054 (hereinafter referred to as the "Lamb et al. patent") discloses a device for making coffee (the "Lamb et al. device") that cannot develop hydrostatic pressure and, consequently, a high flow rate. The bag containing the coffee is formed of an inner sheet of filtering material and an outer semirigid perforated sheet, the latter mechanically reinforcing and supporting the inner sheet. Thus, the Lamb et al. device provides too many flow paths when the device is dunked that do not pass through the substance contained within the device.

U.S. Pat. No. 3,083,101 (hereinafter referred to as the "Noury patent") discloses a device (the "Noury device") for making coffee. The Noury device is an infuser which can be used in simple gravity coffee pots or coffee percolators working under the principles mentioned above. The Noury device, based on its construction, may prevent compaction but cannot develop hydrostatic pressure or a high liquid flow rate.

Great Britain Pat. No. 1,601,335 (hereinafter referred to as the "Ruskin patent") discloses a device (the "Ruskin device") for preparing beverages. The Ruskin device cannot develop hydrostatic pressure and causes compaction. The Ruskin device is an elongated stirrer with a perforated membrane affixed to one end that defines a container for the solid. The membrane permits liquid flow into the container. Infusion is facilitated by stirring the device in water. The stirring action causes wter to pass through the perforated membrane. However, the water tends to flow over, rather than through, the ground coffee. Hence, the water does not move the coffee grounds, and they tend to settle at the bottom, and compaction occurs.

U.S. Pat. No. 4,443,481 (hereinafter referred to as the "Donarumma et al. patent") discloses a coffee infuser (the "Donarumma et al. device"). The Donarumma et al. device has a handle for dunking, but cannot develop hydrostatic pressure because it is constructed of porous tea paper. Fluid flow through the Doaarumma et al. device will follow a path of least resistance, and, thus, will tend to flow around, rather than through, the coffee and through the exposed porous paper. Thus, dunking of the Donarumma et al. device may, in fact, enhance compaction.

U.S. Pat. No. 4,465,697 (hereinafter referred to as the "Brice et al. patent") discloses a coffee brewing apparatus (the "Brice et al. device"). The Brice et al. device contains baffles with or without perforations. The baffles form a plurality of at least partially closed compartments to retain the coffee. The gases generated during brewing flow through and around the baffles and vent through the handle of the device. Because of its design, hydrostatic pressure clearly cannot be developed within the Brice et al. device. While the baffles allow gases generated during brewing to pass in and around the ground coffee beans, compaction will occur within the partially closed compartments because the baffles act as collectors for wet coffee grounds.

Therefore, there exists a need for a device that can, in the brewing of a beverage, develop hydrostatic pressure, resulting in a high flow rate of liquid through the device, and at the same time, prevent compaction of the material to be infused, to ensure that liquid flow occurs through the material.

SUMMARY OF THE INVENTION

The present invention provides a beverage making device to cause hot water to flow through the device at a high rate and to provide a means for preventing compaction of the infusing substance in the beverage-making device.

Preferably, the beverage making device includes a hollow chamber for containing a beverage-making substance. The chamber extends above the beverage-making substance by a substantial distance. When the device is immersed in, and then lifted out of a body of water, a pressure head is produced by a column of water in the upwardly-extending portion of the chamber. The water flows through the chamber because of forces created by hydrostatic pressure differences between open air and liquid, and by gravity.

Preferably, the beverage-making substance, such as ground coffee beans, tea leaves, cocoa powder and similar substances that are either soluble or extractable in liquid, is retained within the chamber of the present invention by two filter screens. A first filter screen is installed in an opening in the base of the chamber, and a second filter screen is located in an upper portion of the chamber remote from the first filter screen.

Prevention of compaction can be attained through use of a chamber is formed in a noncylindrical shape such that cross section of the chamber substantially varies along vertical length of the chamber when the device is standing upright, thus preventing the formation of a wetting slug of substance. Many chamber shapes will accomplish this goal, including conical shapes, hemispherical shapes, or any shape not possessing uniform cross section along the vertical length of the chamber.

Compaction alternately can be prevented by fitting the device with one or more filaments crisscrossing a cylindrical or noncylindrical chamber containing the beverage-making substance so as to break up any clumps or compactions of the beverage-making substance. An alternative method for preventing compaction of beverage-making substance is to provide thin protuberances extending from the inner walls of the chamber into the active region to break up any clumps or compactions of the beverage-making substance.

DETAILED DESCRIPTION OF THE INVENTION

Figure 1:
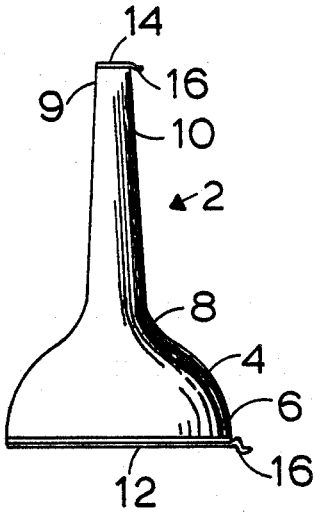
FIG. 1 is a side elevation view of one embodiment of the invention.
Figure 2:
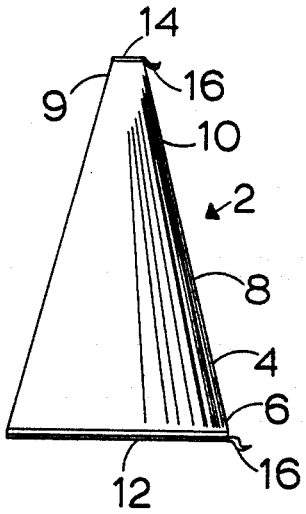
FIG. 2 is a side elevation view of a conical shaped embodiment of the invention.
Figure 3:
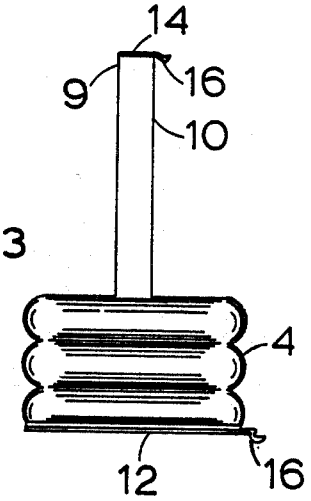
FIG. 3 is a side elevation view of an odd shaped, noncylindrical embodiment of the invention meant to represent an arbitrary device shape without uniform cross section throughout its vertical length.

Referring to FIG. 1, one embodiment of a single-serving beverage brewer is shown. Brewer 2 includes a generally hemispherical portion 4 having a wider lower end 6 and a narrower upper end 8. Lower end 6 of hemisphere 4 allows the brewer to remain upright in a stable position on a shelf for storage, on a table, or in a cup of water. As will be appreciated, brewer 2 may have many shapes. For example, it may be conical (FIG. 2), or be of a variety of odd shapes not having uniform cross section along its vertical length, as generally represented by the embodiment shown in FIG. 3. Integral with upper end 8 is a hollow tube 10 which extends upwardly a distance from chamber 4 to produce a pressure head as will be described below. Brewer 2 should be significantly taller than an ordinary coffee mug so that it always remains in communication with the open atmosphere, and of proper diameter to fit conveniently within a cup or mug.

Figure 5:
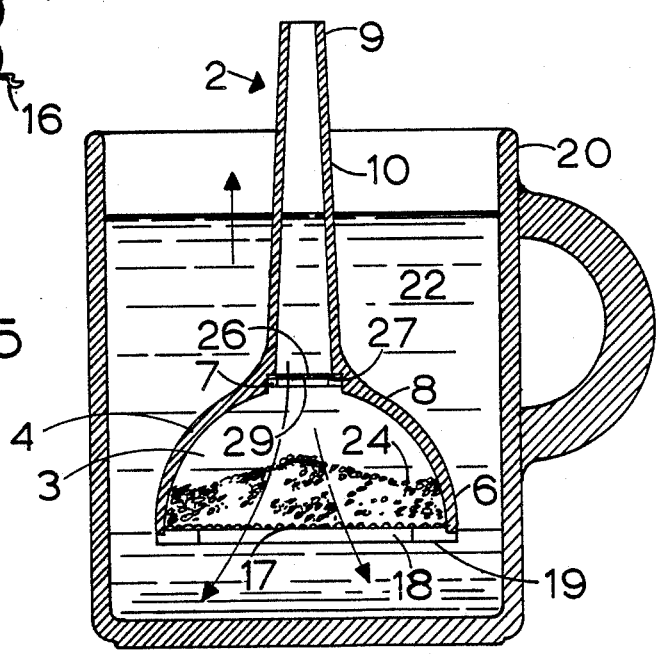
FIG. 5 is a cross-sectional view of the embodiment depicted in FIG. 1 placed in a cup.

A beverage-making substance, such as two teaspoons of ground, roasted coffee beans is contained within compartment 3 of chamber 4 (see FIG. 5). A first seal 12 and a second seal 14 respectively cover an opening at lower end 6 of chamber 4 and distant open end 9 of hollow tube, 10. Seals 12 and 14 preserve the freshness of the foreign matter before use. Seals 12 and 14 are made of thin plastic, paper, or metallic foil, and have inner surfaces coated with an adhesive to maintain them in contact with respective rims of lower end 6 and upper end 9. Seals 12 and 14 each have a pull tab 16 to allow a user to grasp a seal and remove it prior to using the device.

Preferably, chamber 4 and hollow tube 10 are made of a rigid, imperforate material which will withstand prolonged contact with boiling water. This rigid material does not collapse when it is submerged or moved in a cup of water. Because chamber 4 retains its shape, a pressure differential between upper and lower portions of the brewer is created when it is raised with respect to the liquid in the cup. Since chamber 4 is of imperforate material and is open at its lower end 6 and at the connection to tube 10, water drawn into chamber 4 from tube 10 when the device is raised necessarily passes through and swirls substance 24. When the brewer is moved downwardly, water enters base 6 and again passes through substance 24.

Figure 4:
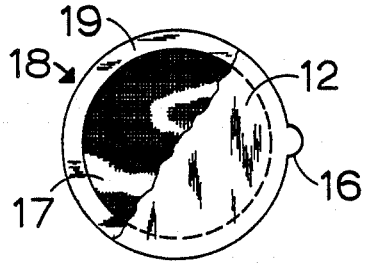
FIG. 4 is a bottom view of the embodiments depicted in FIGS. 1, 2 and 3.

FIG. 4 shows the preferred construction of the first seal as well as that of the first filter 18. Filter 18 comprises an annular peripheral member 19, the center of which is covered by a screen 17 having a mesh sufficient to permit fluid to pass while retaining ground coffee or other substances within chamber 4. Annular member 19 of filter 18 is attached to chamber 4 along a rim of lower end 6. First seal 12 is also attached, preferably by an adhesive, to annular member 19. Seals 12 and 14 ensure that the substance reaches the user while fresh. The outer surface of brewer 2 may bear a commercial name or message.

Referring to FIG. 5, beverage brewer 2 is depicted in use, brewer 2 being partially submerged in cup 20 of hot water 22. When brewer 2 is first submerged, water 22 enters interior compartment 3 of chamber 4 at lower base end 6 through first filter 18. Water 22 flows through filter 18, swirls substance 24, and then flows into hollow tube 10. Because hollow tube 10 is open at its upper end, seals 12 and 14 having been removed prior to use, water 22 in tube 10 readily seeks the level of the water in cup 20. A second filter 26 is preferably installed in the upper end of chamber 4 between tube 10 and chamber 4. Second filter 26 comprises an annular member 27, the center of which is covered by screen 29 having a mesh similar to that of first filter 18. Second filter 26 is secured in notch 7 in the upper end 8 of chamber 4 to ensure that substance 24 remains within the chamber.

Figure 6:
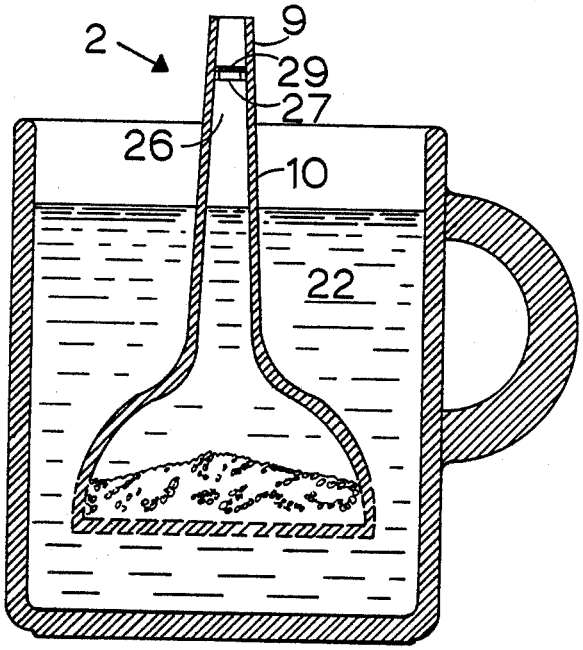
FIG. 6 is a cross-sectional view of the embodiment depicted in FIG. 1 placed in a cup, but showing an alternative placement of the upper filter above the liquid surface.

FIG. 6 shows a brewer 2 similar to brewer 2 shown in FIG. 5 except that second filter 26, annular member 27, and screen 29 are located generally above the surface of water 22 in cup 20. In this embodiment, any tendency to form a meniscus of water 22 across screen 29, which might slow the flow of water 22 through screen 29, is eliminated.

When brewer 2 is lifted partially or totally out of cup 20 by grasping tube 10, water 22 within tube 10 develops a pressure head, thus causing water 22 to flow downwardly into chamber 4. Water 22 flows through substance 24, out through first filter 18, and into cup 20 as the water level within tube 10 once again becomes equal to the water level in cup 20. Brewer 2 is repeatedly moved in the foregoing manner until a beverage having the desired strength has been prepared.

Figure 7:
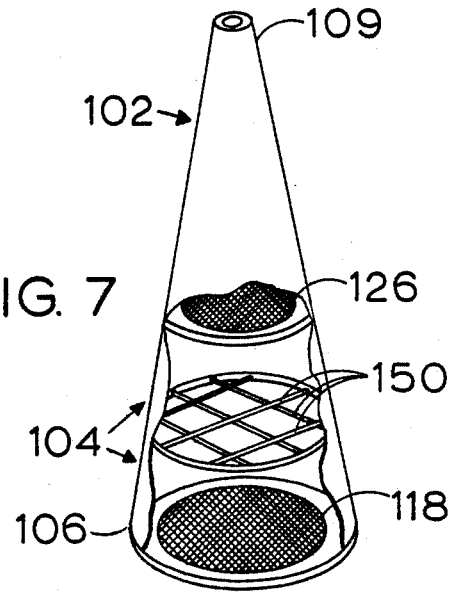
FIG. 7 is a cross-sectional perspective view of the embodiment depicted in FIG. 2 showing thin filaments crisscrossing the chamber.

FIG. 7 shows another embodiment of the present invention. Brewer 102 has a noncylindrical shape and is made of a rigid, imperforate material. A first filter 118 covers lower base end 106 and a second filter 126 is located between first filter 118 and upper end 109. Filter 126 may be installed in any manner, such as by cementing it to the interior wall of brewer 102. Alternatively, the inner wall may have a notch similar to that shown in FIG. 5. Thin filaments 150 are shown in FIG. 7 which crisscross chamber 104, being attached at their ends to the inner wall of chamber 104 in a manner which keeps them tense in the inner compartment of chamber 104. In the brewing operation as described above, filaments 150 provide collision targets for any clumps or compactions of the brewing substance so as to prevent compactions and promote efficient mixing of the substance with water 22 within chamber 104.

Figure 8:
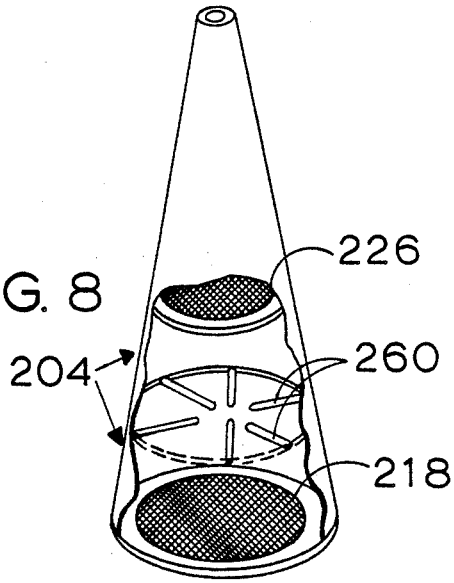
FIG. 8 is a cross-sectional perspective view of the embodiment depicted in FIG. 2 showing protuberances extending inwardly from the inner wall of the chamber.

FIG. 8 shows another embodiment of the present invention. Protuberances 260 extend from the inner walls of chamber 204 inwardly into the compartment and replace filaments 150 shown in the embodiment of FIG. 7. In this embodiment, and during the brewing process as described above, protuberances 260 provide collision targets for any clumps or compactions of the brewing substance so as to prevent compactions and promote efficient mixing of the substance with water within chamber 204.

Figure 9:
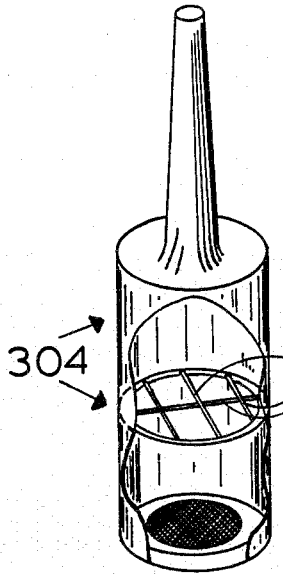
FIG. 9 is a cross-sectipnal perspective view of a cylindrical embodiment of the invention with thin filaments crisscrossing the chamber.

FIG. 9 shows a cylindrical embodiment of the present invention in which filaments 350 crisscross chamber 304 to prevent compaction of the substance during the brewing operation. Crisscrossing filaments 350 render a cylindrical embodiment efficient for brewing coffee, tea, and similar substances which are prone to compaction by preventing the formation of a slug of moist, compacted substance which may move up and down a cylindrical chamber which has no such filaments to break up the slug.

Figure 10:
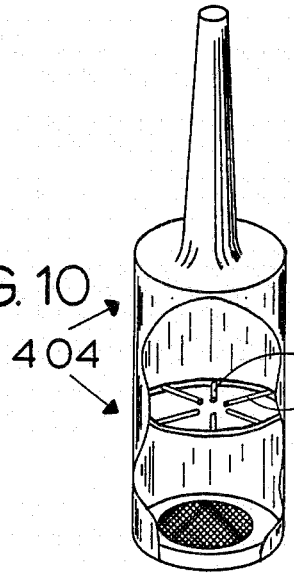
FIG. 10 is a cross-sectional perspective view of a cylindrical embodiment of the invention with protuberances extending inwardly from the inner wall of the chamber.

FIG. 10 shows a cylindrical embodiment of the present invention in which protuberances 460 extend from the inner walls of chamber 404 to prevent compaction of the brewing substance during the brewing operation. Protuberances 460 render a cylindrical embodiment efficient for brewing coffee, tea, and similar substances which are prone to compaction by preventing the formation of a slug of moist, compacted substance which may move up and down a cylindrical chamber which has no such protuberances to break up the slug.

Figure 11:
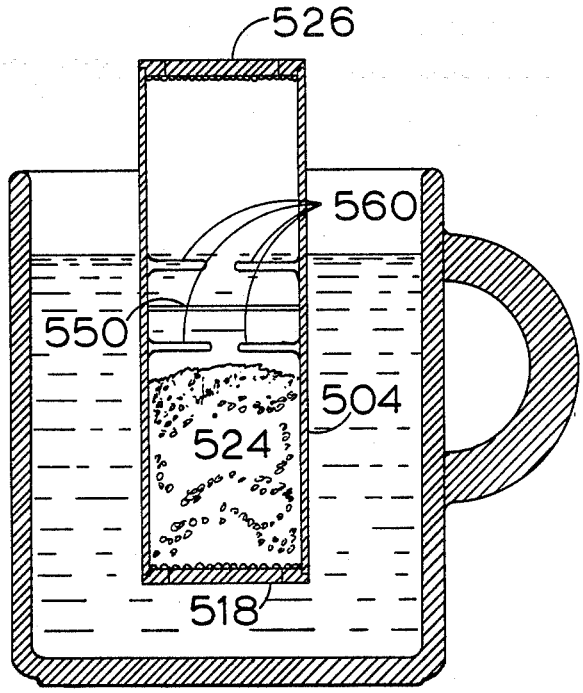
FIG. 11 is a cross-sectional perspective view of a cylindrical embodiment of the invention in which filter location provides a symmetric device.

FIG. 11 shows a cylindrical embodiment of the present invention in which a beverage-making substance 524 is retained in chamber 504 by first filter 518 and second filter 526 placed at opposite ends, and in which thin filaments 550 crisscross chamber 504 and/or protuberances 560 extend from the inner wall of chamber 504 inwardly into chamber 504 to prevent compaction of substance 524. The embodiment shown in FIG. 11 results in a symmetrical brewer, either end of which may be submerged to produce a beverage.

It will be appreciated that the filters in the various embodiments of the present invention perform two functions. They retain the substance in the brewer, and they retain the substance in a specific location in the brewer. In the embodiments shown in FIGS. 5, 7, 8, 9 and 10, in which the upper filter is made of nonwettable material, the filters retain the substance in a part of the brewer which is always below the level of the water when the brewer is in use. In the embodiments shown in FIGS. 6 and 11, in which the upper filter may be made of wettable material, the filters only retain the substance in the brewer, and are so placed above the water as to avoid any possibility of meniscus formation across the upper filter screen which might slow the flow of water through the filter screen.

The brewer can be approximately one to two inches in diameter so that it can easily be submerged in a standard coffee cup or mug. The size of the device need not be so limited, however. Larger devices, for preparing larger quantities of beverage, can be made according to the present invention.

Thus, there has been provided a device for preparing a solution, and more specifically for preparing a beverage. While the invention has been described in conjunction with specific embodiments, it is evident that other alternatives, modifications and variations will be apparent to those skilled in the art. For example, virtually any substance which one desires to introduce into a body of liquid may be contained within the chamber of the present device. The beverage brewers depicted in FIGS. 1 through 11 can be manufactured in a number of ways. For example, chamber 4 and tube 10 of FIG. 5 could be manufactured as an integral unit, or as separate units fitted together by cement, welding, or by snap flanges. Similarly, first filter 18 and second filter 26 can be affixed by cement, welding, or by snap flange arrangement. In manufacturing, second filter 26 is affixed to the chamber 4-tube 10 assembly. A desired quantity of substance 24 is placed within the compartment 3 of chamber 4 and first filter 18 is affixed to base 6 of chamber 4.

Finally, first and second seals 12 and 14 are cemented over the opening in base 6 and over open end 9.

What is claimed is:

1. A device for preparing an infusion comprising:

an elongated device having a chamber portion containing a potable infusion making substance, and an upper hand held pressure head portion capable of producing a pressure head when the device is immersed in and then lifted out of a body of liquid wherein the entire side walls of the device are rigid and imperforate to infusing liquid, and wherein the walls of the device define two horizontal openings, one at each end, the lower end and the upper end when the device is held vertically in a cup or vessel of infusing liquid, said chamber portion formed in a non-cylindrical shape such that the cross section of the chamber substantially varies along its vertical length when the device is held upright in a vessel, sufficient such that said variable cross section can prevent compaction of the infusion making substance when said device is moved in an upward and downward direction through said infusing liquid, said upper hand held pressure head portion being of sufficient height to extend above the level of infusing liquid in said vessel so as to be in free communication with air above;

first filter means covering said lower opening to allow the free flow of infusing liquid while preventing passage of said infusable substance through said lower opening; and second filter means above said substance and at or below said upper opening to allow the free passage of infusing liquid or air while preventing passage of said infusable substance through said upper opening.

2. A device as in claim 1 further comprising removable sealing means for rendering said chamber airtight when not in use.

3. A device as in claim 2 wherein said infusing liquid is water and said infusable substance is ground coffee beans.

4. A device as in claim 2 wherein said infusing liquid is water and said infusable substance is tea leaves.

5. A method of preparing an infusion, comprising the steps of: at least partially submerging the device of claim 1 in a container of liquid, and moving the device in an upward-downward direction through the liquid to cause the liquid to flow from the containing vessel into the lower chamber and swirling freely through the infusable substance during the downstroke, and out of the lower chamber through a filter and into the containing vessel during the upstroke, thereby producing an infusion.

6. A device for preparing an infusion comprising:

an elongated device having a chamber portion containing a potable infusion making substance and an upper hand held pressure head portion capable of producing a pressure head when the device is immersed in and then lifted out of a body of liquid wherein the entire side walls of the device are rigid and imperforate to an infusing liquid, and wherein the walls of the device define two horizontal openings, one at each end, the lower end and the upper end when the device is held vertically in a cup or vessel infusing liquid, said chamber incorporating a series of projections filaments on the inside of said chamber which projections or filaments act to break up compactions of said infusion making substance and promote efficient mixing of the substance with the liquid when said device is moved in an upward and downward direction through said infusing liquid, said upper hand held pressure head portion being of sufficient height to extend above the level of said infusing liquid in said vessel so as to be in free communication with air above first filter means covering said lower opening to allow the free flow of infusing liquid while preventing passage of said infusable substance through said lower opening; and second filter means above said substance and at or below said upper opening to allow the free passage of infusing liquid or air while preventing passage of said infusable substance through said upper opening.

7. A device as in claim 6 further comprising removable sealing means for rendering said chamber airtight when not in use.

8. A device as in claim 7 wherein said infusing liquid is water and said infusable substance is ground coffee beans.

9. A device as in claim 7 wherein said infusing liquid is water and said infusable substance is tea leaves.

10. A method of preparing an infusion, comprising the steps of: at least partially submerging the device of claim 6 in a container of liquid, and moving the device in an upward-downward direction through the liquid to cause the liquid to flow from the containing vessel into the lower chamber and swirling freely through the infusable substance during the downstroke, and out of the lower chamber through a filter and into the containing vessel during the upstroke, thereby producing an infusion.

11. the method of claims 5 or 10 wherein said device further comprises seals attached over said lower and upper portions before use for rendering the device airtight, and wherein said method comprises a step of detaching the seals before submerging the device in a containing vessel of liquid.

* * * * *